United States Patent [19]

Pitre

[11] Patent Number: 4,728,099

[45] Date of Patent: Mar. 1, 1988

[54] VARIABLE RESISTANCE EXERCISE APPARATUS

[76] Inventor: John H. Pitre, 908 Koae St., Honolulu, Hi. 96825

[21] Appl. No.: 726,057

[22] Filed: Apr. 23, 1985

[51] Int. Cl.[4] ..... A63B 21/00

[52] U.S. Cl. ..... 272/72; 272/70; 272/128; 272/132

[58] Field of Search ..... 272/72, 73, 116, DIG. 4, 272/93, 128, 130, 131, 132; 128/25 R

[56] References Cited

U.S. PATENT DOCUMENTS

| | | | |
|---|---|---|---|
| 1,217,292 | 2/1917 | Ferth | 272/72 |
| 3,747,924 | 7/1973 | Champoux | 272/DIG. 4 |
| 3,970,302 | 7/1976 | McFee | 272/130 |
| 4,291,787 | 9/1981 | Brentham | 272/130 X |
| 4,396,188 | 8/1983 | Dreissigacker et al. | 272/72 |

*Primary Examiner*—Richard J. Apley
*Assistant Examiner*—J. Welsh
*Attorney, Agent, or Firm*—Kyle W. Rost

[57] ABSTRACT

An exercise apparatus provides a longitudinally oriented frame having a front end and a rear end, a seat carried on said frame in a forward facing position such that it is capable of carrying a user in a forward facing position with respect to the frame, a foot rest carried by the frame forward of the seat and adapted to receive, in use, the user's feet with legs in a generally forwardly extended position, a pair of hand engagable push/pull handles having one handle located on each of the right and left sides of said seat, each handle being carried by the frame for longitudinal movement approximately between at least the longitudinal positions of the seat and foot rest and for lateral movement approximately between at least a juxtaposed central position and a separated position, a variable resistance device employing a flywheel with centrifugal clutches for variably opposing forces applied longitudinally to the handles, and a diverting mechanism for laterally and yieldably redirecting a portion of forces applied longitudinally to the handles. The push/pull handles pass through a center of balance at an intermediate point of longitudinal travel and, when moving forward of such center, apply gravitationally assisted inertia to stretch the user. A leg exerciser operates from the same flywheel to simulate the full range leg movement of steep climbing.

18 Claims, 12 Drawing Figures

VARIABLE RESISTANCE EXERCISE APPARATUS

BACKGROUND OF THE INVENTION

1. Field of the Invention

The invention relates generally to exercising devices and more specifically to user-manipulated force-resisting mechanism. The invention relates more specifically to a pair of user-interface elements, each enabling a compound exercise movement for conditioning a cross-section of muscle groups in a single exercise.

2. Description of the Prior Art

Numerous exercise machines are known to provide conditioning for specific muscle areas, often requiring that a large number of different exercise movements be performed in order to condition all of the major muscle areas of the body. A common variety of such machines employs a stack of fixed weights at each exercise station. In use, a selected number of the weights are attached to one end of a cable, which is strung within the machine to enable a user-engaged member on the opposite end to be raised, lowered, pushed, or pulled to raise the weights. Usually, the direction of handle movement is in a single line or plane, although some movements may employ an arc.

Exercise machines of the type described require considerable time in order for a user to exercise at each station and thereby exercise all major muscle groups. It would be desirable to reduce the exercise time necessary for a reasonably complete workout. Correspondingly, it would be desirable to create an exercise apparatus that enables complex, compound muscle movement during a single type of exercise at a single station. In addition, it would be desirable to vary the weight or opposing force employed during different parts of a complex movement in accordance with the needs and ability of the user and of the different muscle groups that are used in the different parts of such complex movement. A further desirable feature is to contain such an exercise apparatus in a compact framework.

Still another type of exercise machine is the push/pull exerciser or "rowing machine." This type of machine enables several body parts to participate in simultaneous longitudinal movement, usually against a fluid cylinder. However, the resistance provided by the cylinder is uniform throughout the push/pull cycle, while the strength of muscles used over a broad movement may differ considerably. It would be desirable to proportion the resistance to the strength of the muscles used in different phases of a single, compound movement so that a broad, total body movement could be undertaken efficiently. Another limitation of rowing machines is that the exercise arms or "oars" provide resistance only to longitudinal movement, which limits the efficiency of rowing exercise. Lateral movement is coupled to longitudinal movement by the radius of the oar pivot and, therefore, prevents efficient work to be done against a laterally applied force. Accordingly, it would be desirable to expand the useful scope of push/pull exercises to include movement against laterally yieldable forces, which would enable an increased exercise efficiency.

To achieve the foregoing and other objects and in accordance with the purpose of the present invention, as embodied and broadly described herein, the apparatus and method of this invention may comprise the following.

SUMMARY OF THE INVENTION

Against the described background, it is therefore a general object of the invention to provide an improved exercise apparatus that is capable of conditioning the major muscle groups of the body by a compound exercise movement.

More specifically, an object of the invention is to create an apparatus that exercises the upper body by full range, compound movements of the arms and torso.

Another object is to provide an apparatus that requires compound arm movement, involving both longitudinal forces and side forces during a single exercise.

Still another object is to provide an apparatus that causes the torso to move from a rear arch to a stretched forward extension in a single exercise movement, exercising the entire torso.

An additional object is to provide a resistance mechanism that is responsive to the force applied by the user, such that within a single repetition of an exercise the resistance is automatically increased and decreased according to the force exerted during each phase of the repetition.

A further object is to contour the available range of movement in an exercise apparatus to assist the user through parts of a compound movement where the user's ability to manipulate the apparatus otherwise may be overly limited due to leverage considerations.

A still further object is to provide a leg and lower torso exercise utilizing full range movement and utilizing the same frame and resistance generating means that provided the upper body exercise.

A related object is to provide a standing leg exercise that simulates steep hill climbing.

Additional objects, advantages and novel features of the invention shall be set forth in part in the description that follows, and in part will become apparent to those skilled in the art upon examination of the following or may be learned by the practice of the invention. The object and the advantages of the invention may be realized and attained by means of the instrumentalities and in combinations particularly pointed out in the appended claims.

According to the invention, an exercise apparatus is provided with a longitudinally oriented frame having a front end and a rear end. A seat is carried on said frame in a forward facing position such that it is capable of carrying a user in a forward facing position with respect to the frame. A foot rest is carried by the frame forward of the seat and is adapted to receive, in use, the user's feet with legs in a generally forwardly extended position. A pair of hand engagable handles is provided, having one of the handles located on each of the right and left sides of said seat, each handle being carried by the frame for longitudinal movement approximately between at least the longitudinal positions of the seat and foot rest and for lateral movement approximately between at least a juxtaposed central position and a separated position. A variable resistance means supplies forces that variably oppose those forces applied longitudinally to said handles. In addition, a diverting means laterally and yieldably redirects a portion of forces applied longitudinally to the handles.

According to a further aspect of the invention, in the exercise apparatus the diverting means is responsive to longitudinally forward forces to yieldably urge the handles to mutually diverge, and longitudinally rearward forces are partially diverted to cause the handles to come together.

Still another aspect of the invention is that inertia and gravity are applied at the forward extreme of the exercise movement to draw forward the user's torso in a stretching movement and also at the rearward extreme of the movement to cause rearward stretching of the arms and chest.

The accompanying drawings, which are incorporated in and form a part of the specification illustrate preferred embodiments of the present invention, and together with the description, serve to explain the principles of the invention. In the drawings:

DESCRIPTION OF THE PREFERRED EMBODIMENT

The resistance exercise apparatus 10 provides a framework and drive mechanism that enables a user to perform two complete compound or general movements that exercise all major muscle groups of the human body, encompassing complete muscle groups rather than isolating specific areas. Movement is in a smooth, natural motion, through the body's complete range of movement. The first general movement is the upper body movement, while the second general movement is the leg and lower torso movement. Both may be accomplished against a single drive mechanism carried in a common frame.

Figure 1:
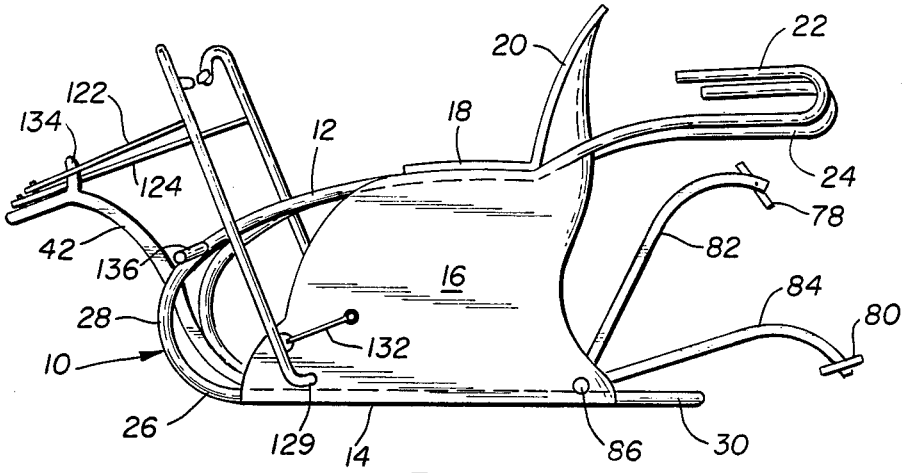
FIG. 1 is a left side perspective view of the exercise apparatus.
Figure 2:
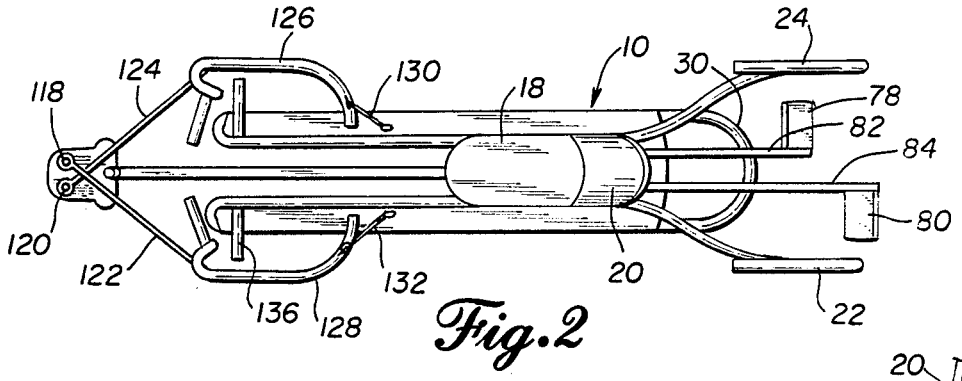
FIG. 2 is a top plan view thereof

With reference to FIGS. 1 and 2, the frame 12 is a support for attachment of operative members of the apparatus as well as a support for the user during exercise. A base 14 supports the frame in a stable manner on the floor and is jointed to a pair of spaced apart right and left side plates 16. A seat or bench 18 forms a top and completes an internal space that houses the drive mechanism. The seat 18 includes a back rest 20, from which the frame may further extend to define rear left and right rear hand holds 22 and 24.

A preferred frame is formed from a solid or tubular framing member 26. This member has a first free end defining the left rear hand hold 22, then curving downwardly in proximity to the left side of the seat back 20 and defining the left support of seat 18. Thereafter, member 26 extends to the forward end of the apparatus 10 and downwardly defining a forward frame member 28, which may be a reverse curve, and then continuing in the rearward direction at floor level to define the base. At a rearward point, the member 26 defines a lateral spacer 30, which may be a horizontal reverse curve, and retraces a parallel path on the right side of the apparatus. The second free end of member 26 then defines the right rear hand hold 24. Left and right side plates 16 may then be mounted to the respective left and right side runs of the member 26 to strengthen the framework by forming a central box structure.

Figure 3:
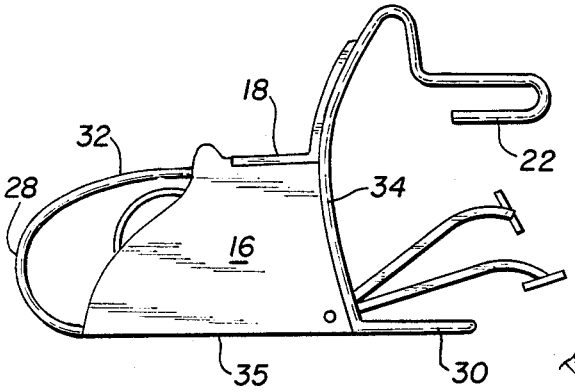
FIG. 3 is a left side elevational view of the frame, showing an alternate frame design for the body of the exercise apparatus.

As shown in FIG. 3, an alternate frame design may include a forward tubular member 32 and a rear tubular member 34. The forward member 32 may extend on one side of the apparatus from the seat 18 through a vertical reverse curve at forward end member 28 to floor level, pass through a horizontal reverse curve at the central box structure, and then return on a parallel path at the opposite side of the apparatus. The rear frame member 34 may extend from the right rear hand hold 24, down the seat back, through a base portion, and horizontal reverse curve 30, returning on the left side to end with left rear hand hold 22. In this alternate design, the side plates 16 join the front and rear tubular members and may be joined additionally by a base plate 35. The tubular member portions on the right and left sides of the frame, in either design, may be interconnected and held at a preselected distance by additional lateral spacers 36, FIG. 11, as required.

Figure 4:
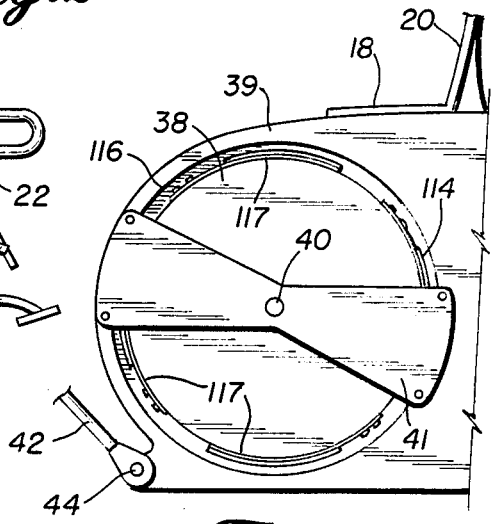
FIG. 4 is a fragmentary left side elevational view of the flywheel area of the exercise devices.

The frame supports a drive mechanism for providing resistance to exercise movements. The main source of resistance is a flywheel 38 housed in the central box structure of the frame, such as between a pair of vertical central carrier plates 39, and carried on a transverse axle 40, as shown in FIG. 4. The carrier plates 39 are attached to the central box structure of the frame. Butterfly mounts 41 support the flywheel axle while providing access to the flywheel area.

Figure 5:
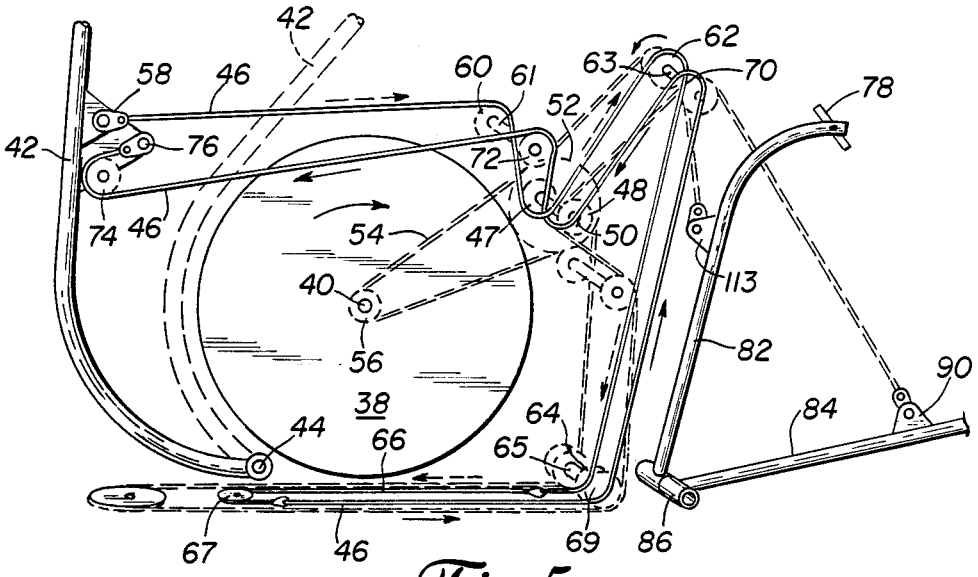
FIG. 5 is a schematic view of the drive mechanism, showing operation of the upper body portion drive mechanism.

Movement is imparted to the flywheel by a unidirectional drive mechanism activated from either of two means. With reference to FIG. 5, for the upper body movement, one means of movement is the push/pull arm 42, which is pivotally attached to the frame, such as at pivot axle 44 carried by the carrier plates 39. The pivot point of axle 44 may be immediately forward of the flywheel and close to floor level, providing a horizontal pivot axis for movement of the arm. At a location spaced apart from the pivot axle, the arm is joined to an actuating means for imparting rotation to the flywheel in response to pivotal motion of the arm on axle 44. For example, such means may include an elongated member such as a roller chain 46 connected at its opposite ends to the arm, with an intermediate portion engaging sprockets 47 and 48 connected by one-way drive clutches to shaft 50. The shaft 50 operates a main drive means for imparting the rotation of shaft 50 to the flywheel. This main drive may include a drive sprocket 52 keyed to shaft 50 for rotation therewith and jointed by a continuous roller chain 54 to main driven sprocket 56, which is keyed to rotate with the flywheel 38 on shaft 40.

A representative routing path for the roller chain loop is shown in FIG. 5 to include mounting member 58 for attaching one end of chain 46 to the push/pull arm 42. The chain is then extended rearwardly to one side of the frame centerline, over an idler sprocket 60 carried on shaft 61, which supports the chain above the level of the flywheel. From the idler sprocket, the chain passes downwardly and around the forward face of one-way sprocket 47 through a substantial arc of as much as a half circle. From the one-way sprocket, the chain extends upwardly and rearwardly over idler sprocket 62 on shaft 63, then down and around the rear of idler sprocket 64 carried on shaft 65 near the base of the frame. In front of sprocket 64, the chain portion of the roller chain loop is coupled to a cable portion 66, which extends forwardly to horizontal pulley wheel 67 carried for rotation on a vertical axis. At pulley wheel 67, the cable path is reversed. The run from sprocket 64 to pulley wheel 67 is at least as long as the maximum available movement of mounting member 58 so that the chain is never engaged by the pulley wheel and the cable is never engaged by the sprocket 64. The pulley wheel horizontally repositions the return run of the cable to the opposite side of the apparatus 10.

The return routing path is parallel to and laterally offset from that previously described. The cable returns toward shaft 65, where the cable is coupled to a further portion of chain 46 that is engaged by idler sprockets 69 and 70, sharing common shafts 65 and 63 with sprockets 64 and 62, respectively. One-way sprocket 48 is next engaged, followed by idler sprocket 72 on shaft 61. Finally, the chain makes a reverse bend around idler sprocket 74 carried on frame portion 28 and is attached to mounting 76 on the push/pull arm, thus closing the chain loop to the arm as a common element. The idler sprockets and shafts thus mentioned are supported by the frame, as is shaft 50. All forward or rearward motion of the push/pull arm 42 is transmitted through the chains and causes rotation of one of the one-way sprockets 47 and 48, thereby driving the flywheel in a single direction. The tension of both the actuating chain and the main drive chain may be controlled by use of conventional spring-loaded tensioning sprockets applied to each of the chains.

For the lower torso and leg movement, the frame carries right and left pedals 78 and 80 mounted, respectively, on leg pedal arms 82 and 84. Transverse shaft 86 is carried in the frame near the rear of the frame and carries the pedal arms for hinged movement at an end opposite from the pedals. Each of the pedal arms is attached to the other by a means for raising one when the other is lowered. The same means may serve as an actuating means for transmitting pedal arm movement to the flywheel 38. A roller chain loop is a suitable means for both purposes.

Figure 6:
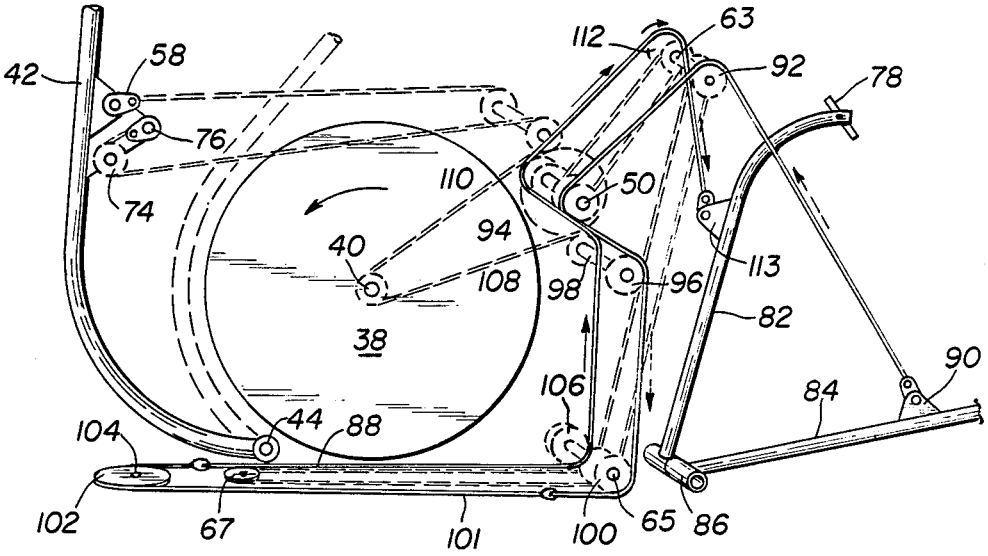
FIG. 6 is a schematic view of the drive mechanism, showing operation of the leg and lower torso portion drive mechanism.

As shown in FIG. 6, a representative routing of roller chain 88 provides a mount member 90 attaching a first end of the chain to left pedal arm 84. The chain then extends generally near the left side of the frame along a path upwardly and forwardly over idler sprocket 92 on shaft 63, and downwardly and forwardly over one-way sprocket 94 on shaft 50. From the one-way sprocket, the chain is routed downwardly and rearwardly over idler sprocket 96 on shaft 98 such that the chain has engaged a large arc of sprocket 94, for example almost one-half circle. The chain is then routed down to idler sprocket 100 on shaft 65, after which the chain is coupled to a central cable portion 101 similar to cable portion 66 described above. The cable portion 101 extends forwardly to a horizontal pulley wheel 102 carried near the front end of the frame on a vertical shaft 104. The length of the cable run from sprocket 100 to pulley wheel 102 is long enough to avoid contact between the chain and pulley wheel or cable and sprocket during any movement of the leg pedal arms. The wheel 102 offsets the cable horizontally in preparation for the return run.

Wheel 102 may be larger in diameter and longitudinally in line with wheel 67 such that the return run of the chain loop may follow a parallel and laterally wider path with portions of chain 46. The return run extends generally along a path near the right side of the frame. Cable 101 is coupled to a further portion of roller chain 88, which extends rearwardly under idler sprocket 106 on shaft 65, upwardly behind idler sprocket 108 on shaft 98, forwardly and upwardly around one-way sprocket 110 on shaft 50, and upwardly and rearwardly over idler sprocket 112 on shaft 63. The second end of chain 88 extends downwardly from sprocket 112 to a point of attachment on a mount member 113 on right pedal arm 82. The movement of either pedal arm therefore causes a reverse movement in the other arm, and movement of either arm acts through the one-way sprockets 94 and 110 to turn the flywheel 38 in a single direction.

While the flywheel serves as a source of resistance due to its mass, the resistance is adapted to variably oppose the user's applied effort, as reflected in the speed of the flywheel. A friction imparting means such as centrifugally operated friction clutches or brake pads 114, FIG. 4, located around the periphery of the flywheel are graduated to provide uniform frictional resistance against a stationary ring 116 carried by the carrier plates 39. The clutches 114 are activated to frictionally contact the ring 116 in proportion to the mass of the weighted backing plates 117. These plates may be of progressively varied thicknesses to create a different mass behind each clutch surface. Thus, as the push/pull arm 42 or leg pedal arms 82 and 84 are moved, the flywheel moves at an increasing speed according to the force exerted by the user. The centrifugal clutches are activated to an increasing degree in response to the increasing speed of the flywheel, automatically providing uniformly increasing resistance to the user's effort.

The drive mechanism is coupled to a suitable operating lever or arm system for performing the upper body movement. The essential elements include a member that interfaces with the drive mechanism to serve as the immediate souce of resistance to the user performing the exercise. This function is illustrated by the push/pull arm 42, which has been partially described above with respect to its interaction with the flywheel. A further essential element is a means for laterally directing a portion of longitudinally directed forces applied to the immediate source of resistance. Specifically, it is desired that such means, which may be carried by the push/pull arm, be adapted to work with a pair of hand engagable grips, such that the means receives a forwardly directed force and redirects a portion of such force to yieldably urge the grips to separate; and to receive a rearwardly directed force and redirect a portion of such force to yieldably urge the grips to come together. An important aspect of the invention is that the yieldable force permits the user to overcome the convergent or divergent urging, so that the user performs the exercise with increasing speed as he is increasingly able to resist the side forces.

One such suitable means is shown in FIGS. 1 and 2 and is generally illustrated throughout FIGS. 7–11. According to this embodiment, the push/pull arm 42 carries right and left laterally separated pivot members 118 and 120, respectively, at a position spaced from axle 44, such as at the opposite end of the push/pull arm and on, respectively, the right and left sides of the frame longitudinal center line. Each pivot is attached to one of two cross-over bars, termed respectively the left and right cross-over bars 122 and 124, respectively. The left bar is attached to the right pivot and vice versa. The cross-over bars extend generally rearwardly from the pivots and cross each other at an intermediate portion of the cross-over bar length such that the end of the right bar opposite from the left pivot member is on the right side of the apparatus, and the end of the left cross-over bar opposite from the right pivot member is on the left side of the apparatus. Thus, the cross-over bars are diagonal or non-parallel to the frame's longitudinal center line.

Figure 11:
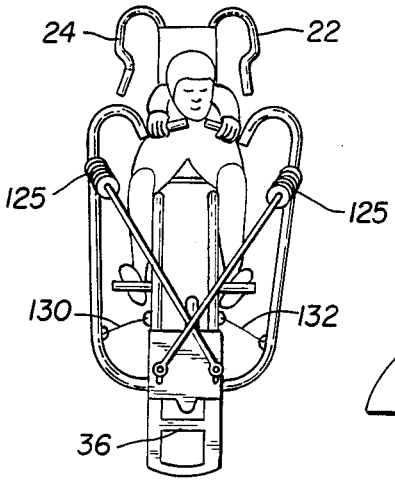
FIG. 11 is a front perspective view of the apparatus, showing a user position similar to FIG. 10.

The ends of the cross-over bars opposite from the pivot members each connect to a hand-engageable handle, such as right and left side push/pull handles 126 and 128, respectively. As shown in FIG. 11, the handles provide a hand grip area at the inwardly curved top portions that terminate in horizontally inwardly extending ends that are directly gripped by the user. The cross-over bars may be attached to the handles by a hinged mounting, and each push/pull handle then may be attached to the frame 12 by a pivotal mounting 129, which may be near the base 14 and located longitudinally forwardly of the seat 18. In an alternate embodiment, the cross-over bars may be integrally connected to the handles, in which instance the pivot points 129 are coaxial with the axis of push/pull arm axle 44. With either arrangement, the portion of the handles engaged by a user are capable of moving along a generally horizontal and convergent or divergent longitudinal path on a broad arc from pivot point 129.

A selected number of weights 125, shown in FIGS. 7–11, are carried by or connected to the handles 126, 128, such as by being carried on the cross-over bars as shown in the drawings or being attached to another part of the operating levers. The weights increase the mass that is moved with the operating levers and, thereby, provide inertia to the levers, as described below. Therefore, the weights may be described as inertial weights due to their mode of functioning in combination with the operating levers.

The operating levers are pivoted to the frame in such a manner that they pass through a longitudinal center of balance at a position forward of the seat, such as when the user's arms are almost straight forward and the torso is against the back rest or perpendicular to the seat. The longitudinal course of lever travel includes a first portion that is rearward of the center of gravity and the second portion that is forward of the center of gravity. Weights 125 add mass and resistance to forward movement of the operating levers through the first portion and contribute gravity-aided inertia to forward movement through the second portion. Similarly, the weights add resistance to rearward movement through the second portion and add gravity-aided inertia to rearward movement through the first portion. While the center of balance may be variable according to the number and locations of the weights 125, it is generally at or near pivotal connection 129 of the push/pull handles or pivot axle 44.

A means is provided for limiting outward lateral position of each push/pull handle and its cross-over bar in accordance with the longitudinal position of the handle. Primarily, it is desired to reduce the requirement on the user to bring together the handles when the user's arms are forwardly extended during forward movement. Such means may comprise a tether such as cables 130, 132 connected between the respective right and left push/pull handles and the frame 12. The point where the cable is mounted to the frame is longitudinally rearwardly of the pivotal mounting between the frame and push/pull handles, permitting the handles to be widely separated when near the rear limit of travel under use, such as at the longitudinal position of the seat 18 or back rest 20. However, as the handles approach the forward limit of travel under use, such as the position of the foot rests 136, the cables become tightly extended and cause the handles to come together on a radius from the anchoring point of the cables to the frame. In this way, the mechanical disadvantage created by the cross-over bars is limited in certain envelopes of use, such as at the forwardmost position of the handles.

A means is also provided for limiting inward or convergent position of the handles. A stop 134 is attached to the push/pull arm 42 at a preselected positioned on the longitudinal rear side of the crossing point of bars 122, 124. If the push/pull handles 126 and 128 are brought too close together, the cross-over bars mutually contact the stop and prevent further inward movement of the handles.

Foot rests 136 may be supported by the frame at adjustable locations on the front part of the tubular member 26, such as above the forward frame member 28. The foot rests are located in front of the seat 18 and at a height slightly below the seat so that a user's feet are supported with his legs generally forwardly extended, as shown in FIGS. 7–11. Pivot point 129 is preferred to be between the longitudinal position of the foot rests and the seat so that the push/pull handles 126 and 128 will be brought through vertical position, through the transverse plane of the pivot point 129, during the upper body exercise, enabling the full inertial benefit of weights 125 to be achieved.

Figure 7:
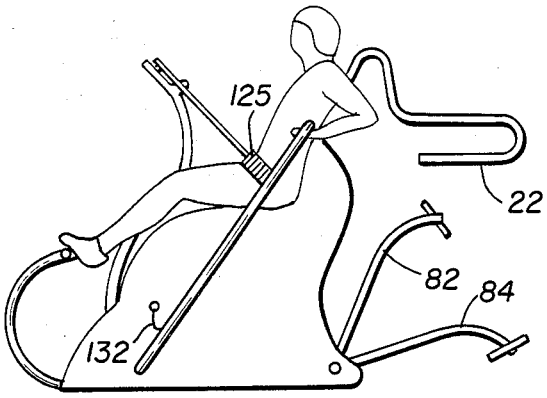
FIG. 7 is a left side elevational view, showing the start of the upper body exercise.
Figure 8:
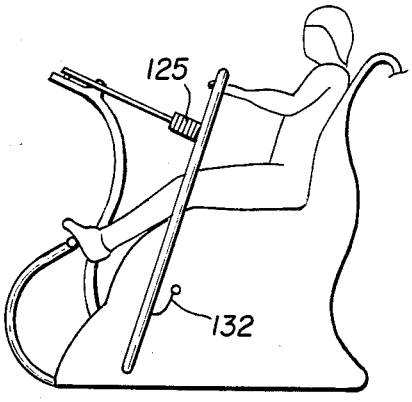
FIG. 8 is a fragmentary view similar to FIG. 7, showing an intermediate stage of the upper body exercise.

In operation and use, the upper body portion of the device enables the user to perform two combined movements that exercise the back, chest, arms, and torso in a complete manner. FIGS. 7–11 illustrate the range of the movement. As shown in FIG. 7, the user begins the movement in a seated position on seat 18, legs extended forward and resting on foot rests 136, and back against the arched back rest 20, which contracts the lumbar region of the lower back and stretches the abdominal region of the stomach. In this starting postion, the user's hands are placed on the push/pull handles 126, 128, which are in their rearward position, approximately in the transverse plane of the back rest 20. These handles, being weighted, provide gravitational resistance and momentum against the user's hands and arms, stretching the pectoral and front deltoid muscles of the chest region. The user pushes the handles forward and away from the body, FIG. 8, simultaneously drawing the handles together until the arms are fully extended and the handles are touching in front of the user's upper torso. Resistance is provided against the user's efforts to bring the handles together by the geometry of the cross-over bars 122, 124, which by scissors-like motion, tend to force the handles apart in direct proportion to the amount of forward pressure being exerted against them. These movements exercise all of the pushing muscles of the upper body.

Figure 9:
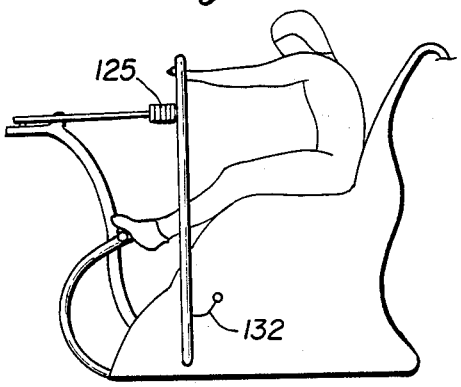
FIG. 9 is a fragmentary view similar to FIG. 8, showing a further intermediate stage of the upper body exercise, wherein the push/pull arms are approximately vertical.

As the forward movement continues, the user's arms become fully extended and locked, FIG. 9, with hands together. Continued forward pushing utilizes the abdominal muscles of the torso to the point of full contraction. Approximately in this phase of the exercise, the push/pull handles pass through the transverse vertical plane of the center of balance, such as the plane containing axle 44 or pivots 129, resulting in the inertial force of the weighted elements producing momentum and gravitational assistance, which pulls the user's torso forward to achieve complete stretching of the lower back, FIGS. 10 and 11. At completion of the forward motion, the hand grips have been moved forward approximately to or beyond the longitudinal position of the foot rests 136.

Figure 10:
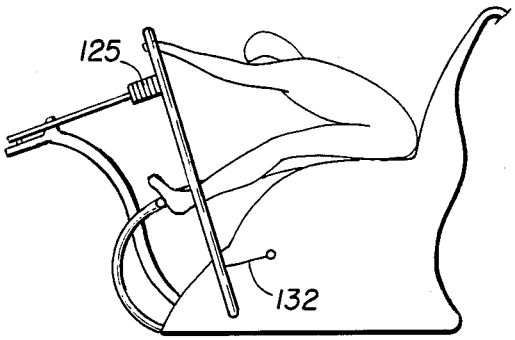
FIG. 10 is a fragmentary view similar to FIG. 9, showing an end stage of the upper body exercise, wherein the push/pull arms are forward of their center of balance.

Initially, in the reverse movement that next follows, the push/pull handles are held together by the forward positioning of cables 130, 132 , FIG. 10. As the user pulls rearwardly with the back muscles, the torso becomes more erect, FIG. 9, and the handles are urged to come or stay together under the influence of the scissors-like motion of the cross-over bars and in response to the pulling force. Thus, now the user must apply muscular force to spread the handles. During continued rearward pulling and spreading, the muscles of the upper and lower back, arm biceps, and rear portion of the deltoid muscles are fully contracted, FIG. 8. Finally, the user's back is again arched, completely flexed, and lying fully against the arched back rest, and the user's arms are fully drawn to the rear. Because the handles again have passed through the center of balance, inertia and gravity further urge the handles rearwardly to apply a gentle rearward stretching to the arms and chest muscles at the conclusion of the rearward movement, FIG. 7. The described upper body exercise is performed in one smooth, continuous motion that completely stretches and flexes all muscles of the upper body.

Figure 12:
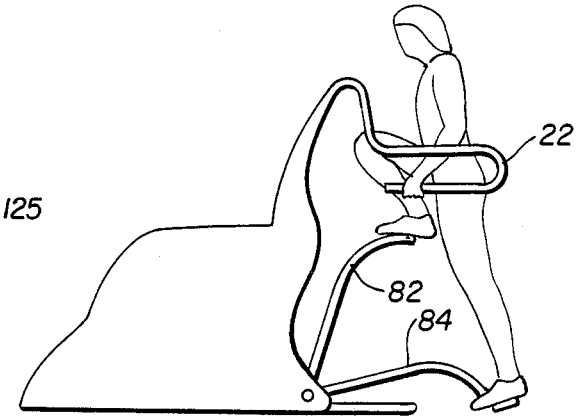
FIG. 12 is a left side elevational view, showing the start of the leg and lower torso exercise.

The leg and lower torso movement, which is illustrated in FIG. 12, simulates the normal motion of climbing, such as a hill or staircase. The user begins the movement by placing one foot on the lower foot pedal 78 or 80. Then the other foot is placed on the second, raised pedal, which is forward of the center line of the user's body. Hand holds 22 and 24 provide body stability during the exercise. The foot pedals 78, 80 pivot about shaft 86, which is forward of the user and at floor level, and which move alternately in an arc from the axis of shaft 86. Pressure is applied one leg at a time, downward through the full range of pedal movement and against the resistance provided by the drive mechanism.

The hand holds 22 and 24 are multi-position, as by utilizing an elongated, horizontal U-shape to provide a plurality grip locations both vertically and horizontally. In addition to providing user support, the hand holds are an additional means for applying resistance. The user may apply the resistance through the hands or by use of a restraining belt attached to the frame. The multi-position handles provide the opportunity for a variety of user positions.

Leg pressure applied by the user is accommodated automatically by the drive mechanism, which presents an equal resistance force at the foot pedal. The leg motion moves each leg, one leg at a time, from a high leg forward position through a full arc to a full leg extension. The movement ensures complete use of all lower torso and leg muscles.

Another aspect of the apparatus 10 is that the flywheel may carry magnets that are detected by electronic sensors, which, in turn, provide performance data to the user. The impulses may interface with computers that provide medical and scientfic health and fitness information, or the feed-back may be psychological in nature to stimulate or prompt a reaction. Still another use of such sensors is to provide video feedback, such as by control a video game or display as an incentive, allowing the exercise to be transformed into a competition against the video game.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be regarded as falling within the scope of the invention as defined by the claims that follow.

The embodiments of the invention in which an exclusive property or privilege is claimed are defined as follows:

1. An exercise apparatus, comprising:

a longitudinally oriented frame having a front end and a rear end;

a seat carried on said frame in a forward facing position such that it is capable of carrying a user in a forward facing position with respect to the frame;

a foot rest carried by the frame forward of said seat and adapted to receive, in use, the user's feet with legs in a generally forwardly extended position;

a pair of hand engagable handles having one handle located on each of the right and left sides of said seat, each handle being carried by said frame for longitudinal movement approximately between at least the longitudinal positions of the seat and foot rest and for lateral movement approximately between at least a juxtaposed central position and a separated position;

a variable resistance means for bidirectionally, automatically variably opposing forces applied longitudinally to said handles in proportion to the applied forces; and diverting means coupling said handles to said resistance means for, in use, receiving forces applied longitudinally to the handles and for laterally redirecting a portion of the forces to yieldably urge the handles to move laterally.

2. The exercise apparatus of claim 1, wherein said diverting means comprises means responsive to longitudinally forward forces for yieldably urging said handles to mutually diverge.

3. The exercise apparatus of claim 1, wherein said diverting means comprises means responsive to longitudinally rearward forces for yieldably urging said handles to mutually converge.

4. The exercise apparatus of claim 1, wherein said hand engageable handles are connected to said frame by a pivotal mount such that the handles are capable of uncoupled longitudinal and lateral movement; and wherein said diverting means comprises:

first and second cross-over bars, each connected at a first end to a different one of said handles, and the cross-over bars crossing each other at an intermediate portion of their length; and a laterally elongated cross-over bar mount connected to said variable resistance means and carrying at laterally spaced apart positions a right side and a left side pivot member, each engaged with a second end of a different one of said cross-over bars such that the first cross-over bar connects the right pivot member and left handle, and the second cross-over bar connects the left pivot member and right handle.

5. The exercise apparatus of claim 4, wherein said pivotal handle mount is located on said frame longitudinally between said seat and said foot rest such that the handles are brought through the transverse plane of the pivotal mount as the handles are brought forward to the longitudinal postion of said foot rest.

6. The exercise apparatus of claim 5, further comprising:

an inertial weight connected to said handles for, in use, continuing existing forward momentum of the handles to apply stretching forces to a user gripping the handles.

7. The exercise apparatus of claim 4, wherein said cross-over bar mount is connected to said resistance means by a push/pull arm pivotally attached at a first end to said frame for longitudinal pivotal movement and carrying said cross-over bar mount at a location on said push/pull arm spaced apart from said first end; and wherein the push/pull arm is centrally located with respect to said handles.

8. The exercise apparatus of claim 7, further comprising inward-position limiting means for preventing convergent movement of said handles beyond a predetermined lateral position and wherein said inward-position limiting means comprises a stop connected to said push-pull arm, extending between said cross-over bars longitudinally rearwardly of their crossing, and contacting the cross-over bars at the limit of convergent movement of the handles.

9. The exercise apparatus of claim 1, wherein said variable resistance means comprises:

a flywheel carried by said frame; and actuating means connected between said handles and said flywheel for transmitting longitudinal movement of the handles to the flywheel, said actuating means comprising a unidirectional drive for imparting unidirectional forces to the flywheel regardless of the direction of longitudinal handle motion.

10. The exercise apparatus of claim 9, wherein said variable resistance means further comprises:

centrifugally actuated friction imparting means operable in response to the speed of flywheel rotation for proportionally applying braking force to the flywheel.

11. The exercise apparatus of claim 10, wherein said flywheel is rotatable with respect to said frame; said friction imparting means comprises a friction clutch carried by the flywheel; and the frame further comprises a ring held in a stationary position with respect to the frame, circumferentially surrounding the flywheel, and in frictional contact with said friction clutch according to the degree of braking force applied.

12. The exercise apparatus of claim 1, further comprising:

outward-position limiting means mounted between the frame and said handles for limiting divergent lateral movement of each of said handles according to the longitudinal position of the handle.

13. The exercise apparatus of claim 1, further comprising:

a pedal axle carried by said frame;

left and right pedal arms, each connected at a first end to said pedal axle for movement through an arc of less than one-half circle and both extending generally rearwardly therefrom to a second end;

a pedal attached near the second end of each pedal arm;

actuating means connecting said pedal arms for causing each pedal arm to raise in response to lowering of the other; and said actuating means connecting both of said pedal arms to said variable resistance means.

14. The exercise apparatus of claim 13, further comprising hand hold means carried by said frame above the pedal arms for, in use, providing a grip for balance and torso hold-down to a user in standing position on said pedals.

15. The exercise apparatus of claim 14, wherein said hand hold means comprises an upper grip and a lower grip.

16. An exercise apparatus, comprising:

a seat having a rearwardly arched back rest;

a frame supporting said seat;

a hand-engageable exercise arm assembly carried by said frame for movement with respect thereto;

the arm assembly including a pair of handles, one handle being located on each lateral side of the seat, having a hand grip area disposed above the level of said seat for engagement, in use, by the hands of a user seated on the seat;

the handles having a pivotal mounting to the frame and being moveable both over a lateral course of travel between a central position and a laterally separated position and over a longitudinal course of travel on said mounting, wherein said lateral and longitudinal courses of travel are independent of each other;

wherein the pivotal mounting is located with respect to the longitudinal course of travel such that a center of balance of the arm assembly passes over the pivotal mounting at a point intermediate the extremes of the longitudinal course of travel, such that the handles are gravity-induced to move longitudinally forwardly of rearwardly away from balanced position;

diverting means responsive, in use, to forwardly applied forces on said handles to yieldably urge the handles to move to said laterally separated position and responsive, in use, to rearwardly applied forces on the handles to yieldably urge the handles to move to said central position; and resistance generating means coupled to said handles by said diverting means for variably opposing forward and rearward movement of the handles in proportion to the longitudinal speed of handle movement.

17. The exercise apparatus of claim 16, wherein said diverting means comprises:

a push/pull arm having a pivoted connection to the frame;

means connecting said push/pull arm to said resistance generating means for transmitting motion of the push/pull arm to the resistance generating means; and a pair of connecting bars, each joining a different one of said handles to said push/pull arm, said connecting bars being at a longitudinally angled orientation from a rearwardly, mutually outwardly angled lateral position at the handles to a central lateral position at the push/pull arm such that forwardly directed longitudinal forces applied to the handles are partially diverted to yieldably urge the handles to separate.

18. The exercise apparatus of claim 17, wherein said connecting bars are crossed with respect to each other at a position between the handles and the push/pull arm.

* * * * *